United States Patent [19]

Hohsho et al.

[11] 4,172,864

[45] Oct. 30, 1979

[54] CARBURETOR

[75] Inventors: Yukio Hohsho; Kimiji Karino; Masakichi Momono; Teruo Yamauchi, all of Katsuta; Takao Teranishi, Hitachi, all of Japan

[73] Assignee: Hitachi, Ltd., Japan

[21] Appl. No.: 943,233

[22] Filed: Sep. 18, 1978

Related U.S. Application Data

[63] Continuation of Ser. No. 745,056, Nov. 26, 1976, abandoned.

[30] Foreign Application Priority Data

Nov. 28, 1975 [JP] Japan ..... 50-14619

[51] Int. Cl.[2] ..... F02M 1/04

[52] U.S. Cl. ..... 261/39 D; 123/179 G; 123/180 T

[58] Field of Search ..... 261/39 D; 123/179 G, 123/180 T

[56] References Cited

U.S. PATENT DOCUMENTS

| | | | |
|---|---|---|---|
| 2,323,222 | 6/1943 | Holley et al. | 261/39 D |
| 2,563,645 | 8/1951 | Ericson | 261/39 D |
| 2,675,792 | 4/1954 | Brown et al. | 261/39 D |
| 2,877,003 | 3/1959 | Goodridge et al. | 261/62 |
| 3,235,237 | 2/1966 | Goetz et al. | 261/41 D |
| 3,885,545 | 5/1975 | Charron et al. | 261/39 D |
| 3,957,026 | 5/1976 | Winkley et al. | 261/39 D |
| 3,967,610 | 7/1976 | Ross | 261/39 D |
| 4,094,931 | 6/1978 | Karino | 261/39 D |

*Primary Examiner*—Tim R. Miles

*Attorney, Agent, or Firm*—Craig and Antonelli

[57] ABSTRACT

A carburetor comprises, in addition to an ordinary carburetor arrangement, a suction system for starting use including a starter throttle valve and fuel metering means which are both controllable for opening and closing and for metering function by a temperature-sensing control member or members. It further includes diaphragm means for placing a restriction on the starter throttle valve at the start of the engine to set the valve to a desired opening and for removing the restriction at the time of self-cranking of the engine.

10 Claims, 2 Drawing Figures

CARBURETOR

This is a continuation of application Ser. No. 745,056, filed Nov. 26, 1976, now abandoned.

BACKGROUND OF THE INVENTION

This invention relates to a carburetor which comprises, in addition to an ordinary carburetor arrangement, a fully automatic starter suction system adapted to operate at the start and during the warming-up of the engine.

Automatic starting devices for carburetors known in the art are roughly classified into two groups; those in one group depend on a choke valve, bimetallic thermostat or the like for the control as described in U.S. Pat. No. 2,124,778, and those in the other group are of the starter valve type which have an auxiliary fuel system independent of the main so that auxiliary fuel can be automatically fed through a mixed charge passage communicated with a carburetor space downstream from the throttle valve. When a device of the former group is employed, human assistance is still necessary. Since the opening of the throttle valve for fast idling is determined by a cam mechanism operable in accordance with choke opening, the operator, when starting the engine, must depress the accelerator pedal to open the throttle valve to a predetermined extent so as to set the fast idle opening. Also, during the warming-up period, the operator has to shift the fast idle cam position and control the throttle opening toward a closing position in order to control the maximum engine speed. When the engine is allowed to warm up with an existing carburetor starting device of the character, the unchanged throttle opening presents a noise problem because it increases the engine speed with the progress of warming-up. To avoid this, the accelerator pedal must be depressed to shift the fast idle cam position once the warming-up has proceeded to a certain point. The devices of the first group are thus not fully automatic in controlling the operation from the start to the conclusion of warming-up of the engine.

Also, because the choke valve located on the upstream side of the nozzle is used to increase the vacuum in the vicinity of the main nozzle for more fuel feed, the rate of suction air flow in front of the main nozzle is not high enough to ensure full atomization of the fuel. This calls for a large supply of fuel for the starting purpose with no small sacrifices of fuel economy and cleanness of the exhaust.

The latter group of the starter valve type feeds fuel by dint of intake vacuum or negative pressure, and therefore has common problems of imperfect gastightness of the starter valve and inadequate controllability of the air-fuel ratio at the cold start and during warming-up. In addition, the starter valves are in many cases disk valves and involve such great frictional forces that, in the case of automatic starting devices using bimetallic thermostats or the like, it has been difficult to ensure the uniformity of quality.

SUMMARY OF THE INVENTION

The object of the present invention is to provide a carburetor which eliminates the above disadvantages of the prior art carburetors and which sets optimum conditions for starting and effects the warming-up as well as starting automatically and smoothly.

According to the invention, there is provided a carburetor comprising, in addition to an ordinary carburetor arrangement, a suction system for starting use including a starter throttle valve and fuel metering means which are both controllable for opening and closing and for metering function by a temperature-sensing control member or members.

Also, there is provided a carburetor of the construction immediately above defined which further includes diaphragm means for placing a restriction on the starter throttle valve at the start of the engine to set the valve to a desired opening and for removing the restriction at the time of self-cranking of the engine.

DESCRIPTION OF THE PREFERRED EMBODIMENTS

Figure 1:
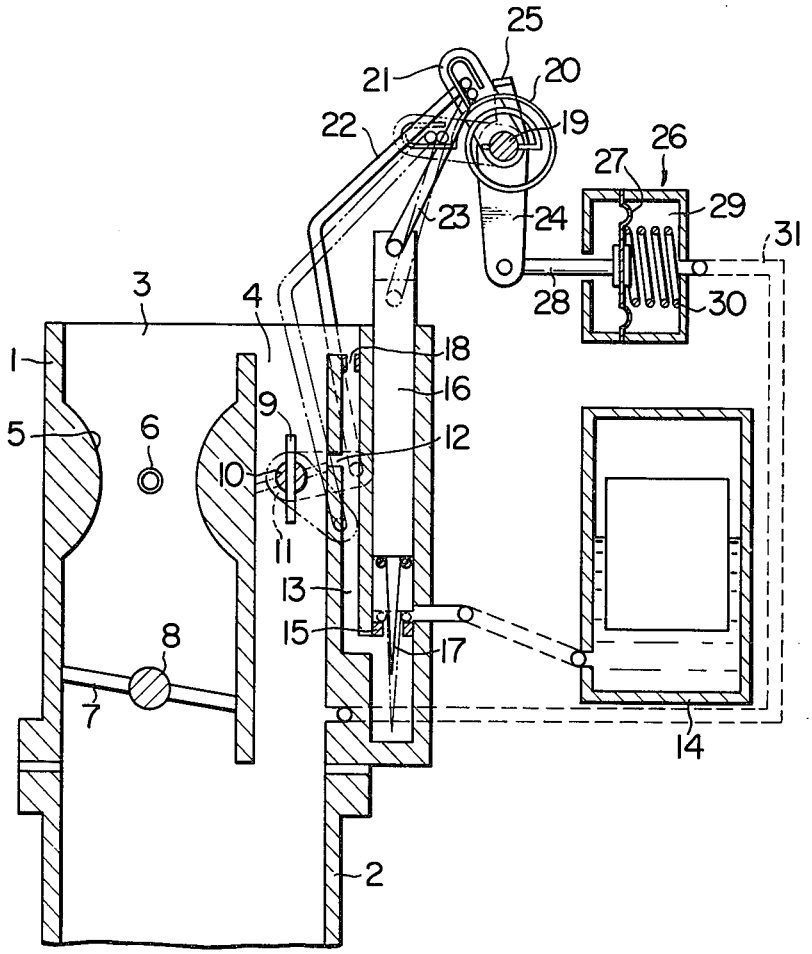
FIG. 1 is a vertical sectional view of one embodiment of a carburetor of the present invention.

In the embodiment shown in FIG. 1, a carburetor 1 is mounted on an intake manifold 2 leading to the inlet ports of engine cylinders. It has a main air horn 3 for normal hot-engine operation and a starter air horn 4 for use in cold starting. The main air horn is formed with a venturi 5 into which a main nozzle 6 is open. On the downstream side of the venturi 5 is installed a main throttle valve 7, rotatably with a main throttle shaft 8, which in turn is linked with the accelerator pedal (not shown). Within the starter air horn 4, a starter throttle valve 9 is rotatably supported by a valve shaft 10, and a starter lever 11 is fixedly connected to the exposed end portion of the starter throttle valve shaft that extends through the surrounding wall of the starter air horn 4. A starter nozzle 12 is open into the air horn 4 at a point near the fully closed position of the starter throttle valve 9, and, through a fuel passage 13, the nozzle is communicated with a float chamber 14. At an intermediate point of the fuel passage 13 is formed a starter orifice 15, through which a starter needle 17 attached to the lower end of a starter valve 16 extends downwardly. A starter air bleed 18 is formed at the upper end of the fuel passage 13. At a location within the engine room subject to the heat of the engine or varying ambient temperature, a fixed pin 19 supports a coil-type bimetallic thermostat 20 at one end, and a thermostat lever 21 is turnably mounted on the fixed pin 19. The thermostat lever 21 is connected, near its free end, with the starter lever 11 and starter valve 16, respectively, by connecting rods 22, 23, and is also engaged with the other end of the thermostat 20.

On the fixed pin 19 is also turnably mounted a self-cranking lever 24 having a lug 25 adapted to engage the thermostat lever 21. The lower end of the lever 24 is pivotally connected to one end of a rod 28, the other end of which is secured to a diaphragm 27 of a self-cranking controller 26. The controller has a diaphragm chamber 29 loaded with a spring 30 which presses the diaphragm 27 outwardly. The diaphragm chamber 29 is communicated through a negative-pressure passage 31 with the downstream space of the starter air horn 4.

The operation of this embodiment will now be explained.

Before cold starting, the tension of the thermostat 20 holds the starter throttle valve in an open position as indicated by full lines and the starter valve 16 in an upper position, providing a gap of a large cross sectional area between the starter orifice 15 and starter needle 17. As the engine is cranked, the starter air horn 4 with a small diameter produces a high rate of air flow past the opening of the starter nozzle 12, and a consequent pressure drop draws out fuel by suction from the float chamber 14 into the air horn 4 through the starter nozzle 12, after the fuel has mixed with primary air from the satrter air bleed 18. The premixed charge is then introduced into the air stream in the starter air horn 4, and the resulting air-fuel mixture is fed to the engine cylinders via the intake manifold 2. Because of the large gap area between the starter orifice and needle, a relatively rich air-fuel mixture suited for cold starting is delivered to the engine cylinders, thus facilitating the starting of the cold engine.

The air-fuel ratio an engine requires during the warming-up period following the self-cranking differs widely from that at the start of the engine. The former requirement is satisfied in the following way. Immediately upon the self-cranking the engine speed increases rapidly and the pressure within the starter air horn 4 downstream from the starter throttle valve 9 decreases, supplying a negative pressure to the diaphragm chamber 29 of the self-cranking controller 26 through the negative-pressure passage 31. As a result, the diaphragm 27 is attracted to the right as viewed in FIG. 1 against the force of the spring 30, while pulling the rod 28 and thereby turning the self-cranking lever 24 counter-clockwise. The lug 25 of the self-cranking lever 24 then pushes the thermostat lever 21 in engagement therewith and forces the latter counter-clockwise, too. This enables the thermostat lever 21 to move both the starter valve 16 and starter throttle valve 9 to closed positions so that the air-fuel ratio may be adjusted to a suitable value for the warming-up. At the same time the amount of the air-fuel mixture being fed to the engine cylinders is regulated by the closing motion of the starter throttle valve 9 to a rate for maintaining an adequate engine speed for the warm up operation. With the progress of the operation, the frictional forces generated by the component parts in motion decrease and the temperature of cooling water or the intake manifold 2 rises to promote the fuel vaporization, tending to increase the engine speed excessively. With the conventional carburetor of the type which controls the choke valve by means of a bimetallic thermostat or the like, the above problem has been solved by the operator who temporarily depresses the accelerator pedal to shift the fast idle cam position and control the throttle opening stepwise to a closed position. For this reason it has been customary that the control of the engine speed during the period from immediately after the self-cranking to the normal idling following the completion of warming-up is accomplished stepwise through manipulation by the driver. In the embodiment being described, the starter throttle valve 9 and the starter valve 16, which are both operatively connected to the thermostat 20 adapted to sense the warming-up condition and accordingly shift its position, move toward their closing positions as the engine temperature increases. In this way they control the air-fuel ratio and the quantity of gaseous mixture to be fed, respectively, without human assistance but fully automatically so that the engine speed may very smoothly increase during the transition period from immediately after the self-cranking to the idling operation that follows warming-up. Moreover, this control is properly performed at all times independently of the operation of the main throttle valve 7.

The embodiment shown in FIG. 1 would exhibit some shortcoming, however, if used in an intensely cold season or district where the temperature may be as low as $-10°$ to $-30°$ C. As such low temperatures the engine oil fluidity and battery capacity will be less than at ordinary temperature. Accordingly, the cranking speed will be lower and the volume of suction air charge in the engine smaller, thus reducing the difference between the atmospheric pressure and the suction negative pressure within the space facing the starter nozzle 12. Therefore, the fuel delivery will be rather inadequate and make the starting of the cold engine somewhat difficult.

Figure 2:
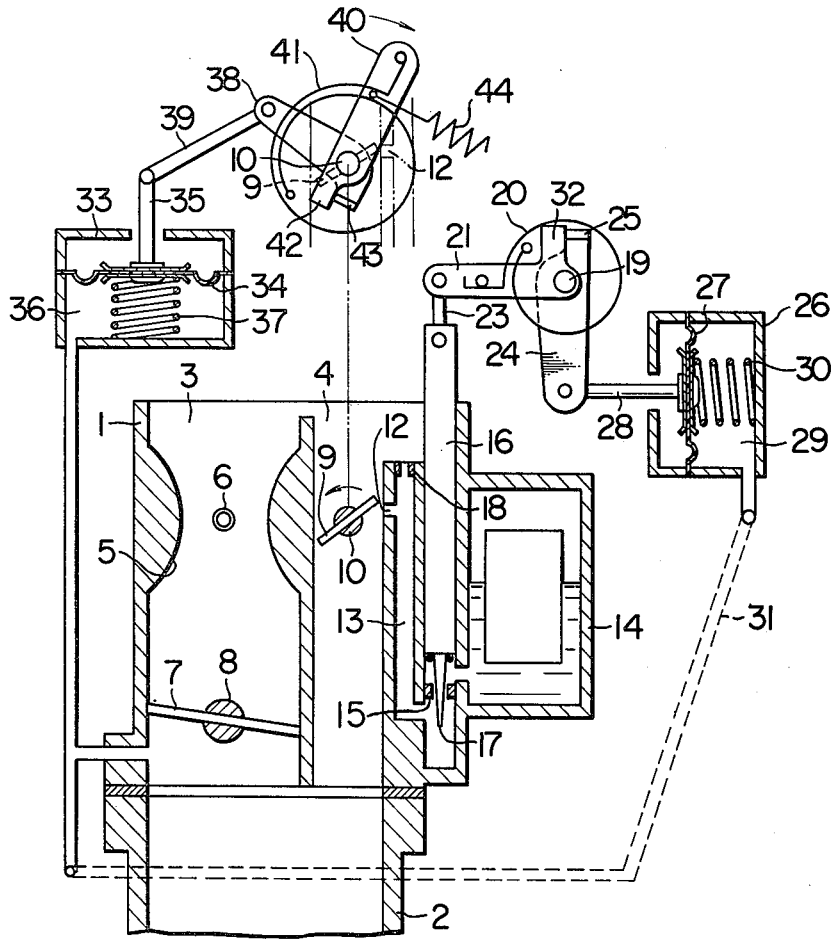
FIG. 2 is a vertical sectional view of another embodiment of the invention.

Another embodiment of the invention shown in FIG. 2 is an improvement which overcomes the above difficulty. In outlining this arrangement, the description of the same component parts as employed in the first embodiment of FIG. 1 will be omitted for simplicity. Referring now to FIG. 2, a starter valve 16 that meters the fuel for starting use is connected by a connecting rod 23 to one end of a thermostat lever 21 which is pivotally supported at the opposite end by a fixed pin 19. To this lever 21 is secured one end of a coil-type bimetallic thermostat 20, the other end of which is fast on a stationary member not shown. On the fixed pin 19 is also turnably mounted a self-cranking lever 24. The lower end of the lever 24 is pivotally connected to one end of a rod 28, the other end of which is secured to a diaphragm 27 of a self-cranking controller 26. A lug 25 formed at the upper end of the self-cranking lever is engaged with an upward extension 32 of the thermostat lever 21. The controller 26 has a diaphragm chamber 29 loaded with a spring 30 and communicated with the main air horn 3 downstream from the main throttle valve 7 through a negative-pressure passage 31. As described the control mechanism for the starter valve 16 is substantially the same as that of FIG. 1, but the control mechanism for the starter throttle valve 9 differs from the preceding one in the manner now to be explained. The negative-pressure passage 31 is branched outside the main air horn to form a conduit leading to the diaphragm chamber 36 of another self-cranking controller 33. A rod 35 secured at one end to the diaphragm 34 of the self-cranking controller is linked at the other end by a connecting rod 39 to one end of a self-cranking lever 38 pivotally supported by a starter throttle valve shaft 10, as separately illustrated in the upper part of FIG. 2. To the starter throttle valve shaft 10 is secured the lower end portion of a thermostat lever 40 which, in turn, engages one end of a coil-type bimetallic thermostat 41, the other end of which is anchored to a stationary part not shown. A lug 42 formed at the lower end of the thermostat lever 40 is engaged with a mating lug 43 at the lower end of the self-cranking lever 38. Numeral 37 denotes a spring biasing the diaphragm 34 of the self-cranking controller outwardly of the case, and 44 denotes a return spring for the thermostat lever.

With the carburetor of the construction described, the engine is started in the cold season as follows. While the coil-type thermostat 41 exerts a tension on the thermostat lever 40 to move the starting throttle valve 9 toward its open position, holding the lever in the position shown the pressing force of the spring 37 of the self-cranking controller 33 biases the self-cranking lever 38 clockwise. Therefore, the starter throttle valve 9 secured to the thermostat lever tends to be turned toward the open position by the tension of the thermostat 41, but the turning motion is restricted by the lug 43 of the self-cranking lever 38 in engagement with the lug 42 of the thermostat lever 40. As a result, the starter throttle valve is held in the position shown, or slightly open from the completely closed state. The starter valve 16, on the other hand, is kept in the upper position as shown by the tension of the coil-type thermostat 20 that has resulted from the coldness, leaving behind a large gap area between a starter needle 17 and a starter orifice 15. This positional relationship is maintained throughout the period from the start to self-cranking of the engine. With the starter throttle valve slightly open, the engine can easily start in an extremely cold season when the cranking speed is low as already stated, because the negative pressure in the vicinity of the starter nozzle 12 is high enough to draw out sufficient fuel for the cold starting. Immediately after the self-cranking, the engine speed increases rapidly and the pressure in the main air horn space downstream from the main throttle valve 7 drops, causing the resulting negative pressure to flow through the negative-pressure passage 31 into the diaphragm chamber 36 of the self-cranking controller 33. As a result, the diaphragm 36 is attracted downwardly as viewed in FIG. 2 against the force of the spring 37. The diaphragm 36 thus pulls the rod 35 and connecting rod 39 and thereby causes the self-cranking lever 38 to turn counter-clockwise while removing the restriction from the thermostat lever 40. Consequently, the starter throttle valve shaft 10 fixed to the thermostat lever 40 is rotated by the tension of the bimetallic spring 41 in the direction to open the starter throttle valve 9, thus determining the starter throttle opening in accordance with the ambient temperature or the temperature of the engine being warmed up. Furthermore, as will be apparent to those of ordinary skill in the art, as the engine warms up and heat is transmitted to bimetallic spring 41, the force exerted by bimetallic spring 41 will decrease, such that once the force exerted by spring 41 becomes less than that exerted by spring 44, thermostat lever 40 will be turned in the direction of the arrow illustrated adjacent thereto in FIG. 2. It is noted that the use of a bimetallic spring thermostat in conjunction with a counterbalance spring to regulate a carburetor throttle plate per se is known and is shown, for example, in the aforementioned U.S. Pat. No. 2,124,778. Clockwise movement of lever 40 will continue under action of spring 44 until throttle valve 9 is fully closed and warm-up is completed. Similarly, the negative pressure introduced into the self-cranking controller 26 pushes the diaphragm 27 outwardly and thereby turns the self-cranking lever 24 counter-clockwise. This, in turn, causes the thermostat lever 21 and connecting rod 23 to lower the starter valve 16. The downward movement of the valve reduces the gap area between the starter needle 17 and starter orifice 15 so that the fuel supply may be controlled to provide a suitable air-fuel ratio for warming-up. The control of fuel feed with the progress of the warming-up is accomplished by the movement of the starter valve 15 with changes in tension of the heat-responsive coil-type thermostat 20. Thus, it can be seen that once warm-up is completed the valves 9 and 16 are both closed and the oridinary (or main) carburetor is unaffected thereby.

As has been stated above, the carburetor of the present invention uses a starter air horn which is small enough in diameter to produce a high rate of suction air flow in front of the starter nozzle and therefore relative to the fuel flow, thus contributing greatly to the fine atomization of the fuel. In this way a combustible mixture for starting or warming-up use can be fed to the engine positively and stably without increasing the air-fuel ratio to an overrich state as has been customary in the past. This is most effective in improving the fuel economy and purifying the exhaust gases. Also, as described, the air-fuel mixture is fed during the period from the cold start to the completion of warming-up solely by the starter throttle valve under control by a heat-sensing control member or members, such as a coil-type bimetallic thermostat or thermostats, independently of the main throttle valve. This makes possible the maintenance of an engine speed at all times best suited for the process of warming-up, solving the problem of exhaust noise during the warming-up and avoiding any unusual increase in the engine speed during the period. Consequently, the engine life is greatly extended. The ommission of the choke valve helps decrease the overall height of the carburetor, making the engine small and compact and easily mountable in the vehicle. Another important advantage of the carburetor embodying the invention is that it dispenses with the unloader mechanism that is essential for conventional starting devices using automatic choke or the like. Usually, when the air-fuel mixture becomes too rich because of overchoking, overflow, or percolation at the start of the engine, the unloader mechanism cooperates with the main throttle valve to eliminate the choking effect. According to the present invention, the negative pressure against the starter nozzle can be reduced by opening the main throttle valve and therefore the unloader means is not required when the engine incorporating the carburetor of the invention is built to ordinary specifications. Thus, despite the simplicity of the mechanism, the arrangement embodying the invention can meet the requirements of a fully automatic starting device.

What is claimed is:

1. A carburetor comprising, in addition to an ordinary carburetor, a starter air horn, a starter throttle valve arranged in said starter air horn, a starter nozzle which opens inside of said starter air horn at a position slightly upstream of the starter throttle valve when said starter throttle valve is in a fully closed state, a fuel feed passage connecting said starter nozzle to a float chamber, a starter valve arranged in said fuel feed passage, a first bimetallic thermostat operatively connected to said starter valve so as to move the latter toward its closed position as the engine temperature rises, a self-cranking controller operatively connected to said starter throttle valve so as to move the latter toward its open position when said controller is actuated by the vacuum in the intake manifold at the self-cranking of the engine, and a second bimetallic thermostat operatively connected to said starter throttle valve so as to close the latter from the self-cranking opening degree and to enable closure of said starter throttle valve as the engine warms up.

2. A carburetor according to claim 1, wherein said starter nozzle is positioned in said starter air horn at a point which is downstream of the starter throttle valve when said throttle valve is in a starting position and upstream of said starter throttle valve when the same is fully closed.

3. A carburetor according to claim 1, wherein said starter valve is designed to fully close said fuel feed passage when the engine temperature rises to a predetermined level so as to fully shut off the supply of fuel to said starter nozzle.

4. A carburetor according to claim 1, wherein said self-cranking controller comprises a diaphragm which is moved by the vacuum in the intake manifold, and a spring biasing the diaphragm in a direction reverse to that of the movement caused by the vacuum, the pressing force of said spring being greater than the force of said second bimetallic thermostat acting on the starter throttle valve to move the same toward its open position when the temperature of said thermostat is low, whereby the opening degree of said starter throttle valve at starting is kept smaller than that of self-cranking, but larger than the full close.

5. A carburetor according to claim 1, wherein a second self-cranking controller actuated by the vacuum in the intake manifold is operatively connected to said starter valve so as to move the latter toward its closing position at the self-cranking.

6. A carburetor of the type having a main carburetor and a starter air horn comprising:

a starter throttle valve arranged in said air horn;

a fuel feed passage for supplying fuel to said air horn;

a starter valve arranged in said fuel feed passage;

a first bimetallic thermostat and vacuum operated means, for controlling the extent to which said starter throttle valve is opened; and a second bimetallic and vacuum operated means, for controlling the extent said starter valve is opened independent of said first means and starter throttle valve, said first means functioning to maintain said starter throttle valve in a slightly opened position during engine starting, a progressively adjusted engine temperature-dependent open position during engine warm-up and a closed position after engine warm-up, and said second means functioning to maintain said starter valve in an open position during engine starting, a partially closed position during engine warm-up and a closed position after engine warm-up.

7. A carburetor according to claim 6, wherein said starter valve and said starter throttle valve are controlled independent of said main carburetor.

8. A carburetor according to claim 7, wherein said first means and said starter throttle valve are operatively associated with a first self-cranking controller.

9. A carburetor according to claim 8, wherein said second means and said starter valve are operatively associated with a second self-cranking controller.

10. A carburetor according to claim 6, wherein said starter throttle valve is positioned with respect to said feed passage such that said feed passage opens into said air horn downstream of said starter throttle valve when said throttle valve is open and is located upstream relative to said starter throttle valve when said throttle valve is closed.

* * * * *